US005426903A

United States Patent [19]

Ramm et al.

[11] Patent Number: 5,426,903

[45] Date of Patent: Jun. 27, 1995

[54] WELD-ON DOWL FOR A STEEL/CONCRETE COMPOSITE CONSTRUCTION

[76] Inventors: Wieland Ramm, Rundwiesen 5, 6750 Kaiserslautern 31; Joachim Scheele, Landenbergerstrasse 24, 7300 Esslingen, both of Germany

[21] Appl. No.: 115,597

[22] Filed: Sep. 3, 1993

Related U.S. Application Data

[63] Continuation of Ser. No. 736,750, Jul. 26, 1991.

[30] Foreign Application Priority Data

Jul. 26, 1990 [DE] Germany ..... 40 23 692.7

[51] Int. Cl.[6] ..... E04B 1/16

[52] U.S. Cl. ..... 52/334; 52/378

[58] Field of Search ..... 52/334, 336, 511, 506, 52/508, 513, 309.8, 309.9, 309.11, 378, 426, 428, 430, 733; 411/171, 379, 380, 381, 382, 930

[56] References Cited

U.S. PATENT DOCUMENTS

| | | | |
|---|---|---|---|
| 1,662,896 | 3/1928 | Pauling | 52/334 |
| 1,837,793 | 12/1931 | Randall | 411/494 |
| 1,956,354 | 4/1934 | Junkers | 52/378 |
| 2,040,365 | 5/1936 | Diehl et al. | 52/511 |
| 2,367,657 | 1/1945 | Boersma | 52/511 |
| 2,537,466 | 1/1951 | Kiefer | 52/511 |
| 2,623,508 | 12/1952 | Tross | 411/379 |
| 2,987,855 | 6/1961 | Singleton et al. . | |
| 3,210,900 | 10/1965 | Sattler . | |
| 4,226,068 | 10/1980 | Wadsworth | 52/508 |
| 4,445,303 | 5/1984 | Judkins . | |
| 4,741,138 | 5/1988 | Rongoe, Jr. | 52/336 |

FOREIGN PATENT DOCUMENTS

| | | | |
|---|---|---|---|
| 1247172 | 10/1960 | France | 52/378 |
| 3419315 | 5/1984 | Germany . | |
| 3507197 | 3/1985 | Germany . | |

*Primary Examiner*—Michael Safavi

*Attorney, Agent, or Firm*—Antonelli, Terry, Stout & Kraus

[57] ABSTRACT

Metal weld-on dowel for steel/concrete composite constructions, which has at one end, a weld-on end and at the other end a head for anchoring in the concrete. For improving the load-carrying behavior in the case of shear loading, at the weld-on end the shank has a portion with an increased cross-section compared with the shank.

13 Claims, 3 Drawing Sheets

F (kN)
200
160
120
80
40
0
4.0
8.0
12.0
16.0
20.0
24.0
28.0
s (mm)
A
B
C

WELD-ON DOWL FOR A STEEL/CONCRETE COMPOSITE CONSTRUCTION

This is a continuation of application Ser. No. 736,750 filed Jul. 26, 1991.

FIELD OF THE INVENTION

The invention relates to a metal weld-on dowel for a steel/concrete composite construction with a shank or shaft, which has at one end a weld-on end for welding onto a steel component, whilst at the other end there is generally a head for anchoring in the concrete.

BACKGROUND OF THE INVENTION

The building industry offers numerous different uses for the aforementioned dowels, particular reference being made to the use in steel/concrete composite constructions. For this purpose dowels are welded by a known stud welding process to a steel component to be connected to the concrete. Such a steel component can, for example, be a composite beam (for bridge or building construction), a metal liner for reinforced or prestressed concrete hollow bodies or buildings (DE-A-3 322 998, De-A-30 09 826) or an anchor plate for anchoring loads in a concrete structure. Generally, the concrete is connected directly to the steel component, the latter optionally simultaneously forming the framework or part thereof.

The load-carrying behavior of the dowel is of great constructional significance for such steel/concrete composite components. A distinction must be made between tensile loads, i.e. in the direction of the dowel longitudinal axis, and shear loads, i.e. in the direction of the steel/concrete interface. Great significance is attached to the load-carrying behavior of the dowel with respect to the shear load, which e.g. occurs as a systematic load due to shear stresses between the steel and concrete or can be introduced in the form of a load to be anchored. Shear loading can also occur, for example, as a result of thermal expansions, settlement phenomena, etc.

An important aspect of the dowel load-carrying behavior in the case of shear-off loading is the failure type. The failure of a dowel connection of the aforementioned type can either occur in the form of a steel failure (the dowel shears or tears off) or in the form of a concrete failure (breaking out from a generally funnel-shaped concrete part). It is more favorable for the load-carrying behavior of the connection if a concrete failure can be avoided, such as is also the case with most existing steel/concrete composite constructions by using sufficiently long dowels.

The load-carrying behavior with respect to shear loading is essentially determined by two parameters, namely the failure or breaking load, i.e. the maximum shear force which can be absorbed by the dowel connection, and the failure or break displacement, i.e. the maximum displacement between the steel component and the concrete. The load-carrying behavior can be clearly shown by plotting the shear force over the displacement as a so-called load-strain line. The area under this line is referred to as the working capacity or energy of the dowel and it is desirable for the latter to have a high value.

SUMMARY OF THE INVENTION

The aim of the invention is to provide a dowel of the aforementioned type with an improved load-carrying behavior in the case of shear loading.

The problem is solved in that, at the weld-on end, the shank has a portion having a larger cross-section than the shank.

The invention takes account of the fact that with a conventional dowel, in the case of high loading, wide areas of the dowel shank participate in reducing the shear loading in the concrete, load removal mainly taking place as a result of pressures between the dowel shank and the concrete. As a result of the inventively reinforced portion in the vicinity of the weld-on end these pressures are highly concentrated in the vicinity of said portion. Therefore the concrete displacement accompanying the dowel displacement is reinforced, which leads to greater dowel displacements and to a more pronounced activation of further load removal mechanisms, such as, for example, axial tensions in the deformed or strained bolt. Tests have surprisingly revealed that dowels having the inventively reinforced portion not only have a much more favorable load-carrying behavior than conventional dowels with a constant diameter over the entire length, which corresponds to the shank diameter of the inventive dowel, but that also, if the diameter of the conventional dowel corresponds to that of the inventively reinforced portion, the load-carrying behavior of the dowel with the constant diameter is inferior than that of dowels with the reinforced portion. Thus, it is unimportant for the concept of the invention whether an inventive design of the dowel is obtained by reducing the shank cross-section or by reinforcement in the vicinity of the weld-on end. What is important is the marked increase in the failure displacement and the resulting increase in the working capacity. It is also important that a marked increase is obtained with respect to the failure load if the choice is made of a dowel reinforced at the weld-on end, while only minor losses in connection with the failure load occur if the inventive dowel is looked upon as a dowel with a reduced shank diameter.

Particularly easy manufacturing is obtained if the shank and the portion are constructed rotationally symmetrically to a common axis. In addition, such a dowel has a symmetrical load-carrying behaviour.

For specific load combinations it can also be advantageous to give the shank or portion a prismatic construction.

According to a simple preferred construction, at least one of the shank or the portion in each case are shaped like a straight circular cylinder. However, to further optimize the load-carrying behaviour, the portion can be made convex in the axial direction.

Due to the fact that the portion passes into the shank with a constant taper, a more uniform overall stressing of the dowel is achieved, particularly in the vicinity of the transition from the increased cross-section portion to the normal cross-section shank and a notch effect, which is undesired in conjunction with dynamic stresses, is avoided.

To ensure an adequate anchoring in the concrete, in the conventional manner the dowel can have a head, Then, according to the invention, the head diameter may be at least as large as the portion diameter.

In a preferred construction, the length to diameter ratio of the portion is between 1:2 and 4:2 and is preferably 1:2 and 3:2. Thus, the dowel can be welded by known stud welding processes and a particularly favorable strain behavior is ensured.

In a further preferred manner, the ratio of the length to the diameter of the shank without a head and without a portion is approximately 3:1 or greater, which ensures an adequate dowel anchoring in the concrete and tearing of the dowel from the concrete due to the shear stressing is avoided.

To optimize the working capacity of a dowel, the diameter ratio of the portion to that of the shaft is, between 7:6 and 10:6 and is preferably, approximately 9:6 and/or the length ratio of the portion to that of the shank without head and without portion is at least 1:3 and the upper limit can be 1:8. Preferably, this ratio is between 1:4 and 1:7.

It can also be provided to further improve the strain behavior that the portion has a stepped cross-sectional increase.

BRIEF DESCRIPTION OF THE DRAWINGS

The invention is described in greater detail hereinafter relative to an embodiment and with reference to the attached drawings, wherein show.

DETAILED DESCRIPTION

Figure 1:
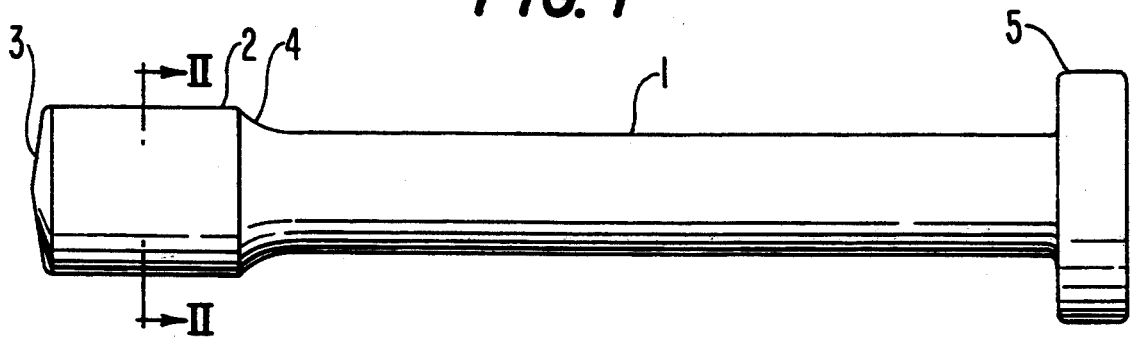
FIG. 1. A side view of a weld-dowel construction in accordance with the present invention.

FIG. 1 shows a weld-on dowel with a shank 1 and weld-on end portion 2 having a weld-on end 3 which in each case are shaped as a straight circular cylinder. In the illustrated embodiment, the portion 2 passes uniformly via a transition portion 4 into the shank 1. By virtue of the free end of the portion 2, (i.e., the weld-on end 3), the dowel is welded by a stud welding apparatus onto a steel components.

Figure 8:
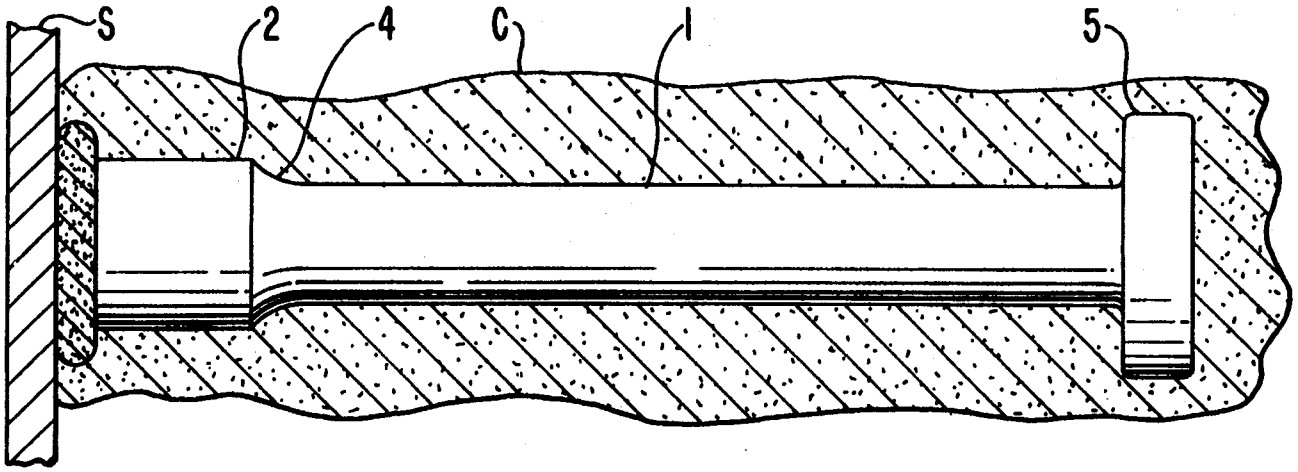
FIG. 8 is a cross-sectional view of a dowel of the present invention as employed in a steel/concrete composite construction.

At the end opposite to the weld-on end 3, in the illustrated embodiment the dowel has a head 5, which is used for transferring stresses directed parallel to the longitudinal axis of the dowel between the latter and the concrete C (FIG. 8) and therefore improves the anchoring of the dowel in the concrete C.

Figure 2:
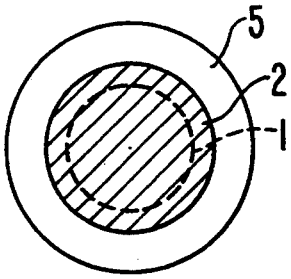
FIG. 2. A cross sectional view taken along the line II—II in FIG. 1.

It is clearly possible to see from FIG. 2 the circular cross-section of the portion 2, the head 5 and in broken line from the shank 1. In this embodiment the diameter of the portion 2 is increased by approximately 40% as compared with the diameter of the shank 1. To ensure a good anchoring of the dowel in the concrete C, the diameter of the head 5 is much larger than the portion 2. As the portion 2, the shank 1 and the head 5 are located rotationally symmetrically on one axis, the dowel can easily be manufactured.

In the assembled condition the entire dowel is inserted in the concrete C. In the case of a shear load, for example, a load at right angles to the longitudinal axis of the dowel in the vicinity of the weld-on end 3, high pressures occur between the dowel and the concrete C. With small shear loads, the pressures are concentrated in the vicinity of the weld-on end. As the shear loading increases, the size of the area of the dowel which in this form is used for load removal purposes is increased. In the case of dowels having a constant diameter over the entire length, this area can expand to almost the entire dowel length, as a function of the concrete composition. This more particularly applies in the case of dowels with large diameters having a high flexural stiffness. If the diameter of the conventional dowel is reduced to approximately ⅔ of the original diameter over a length of approximately 80% from the head 5, then the inventive dowel according to FIG. 1 is obtained. In the case of high shear loads, the pressures are concentrated in the vicinity of the portion 2 with this dowel. Compared with a conventional dowel with a diameter corresponding to that of the portion 2, the transferable shear loads are somewhat lower. However, they are clearly above the shear loads which can be transferred by a conventional dowel with a diameter corresponding to that of the shank 1. Due to the concentration of the pressures in the vicinity of the portion 2, the concrete C is more highly stressed there than in the case of conventional dowels. This leads to greater concrete deformations and to an increase in the locally defined areas of the concrete displacement. In turn, this allows greater dowel displacements, i.e. greater displacements of the dowel base, which in this case corresponds to the portion 2, at right angles to the longitudinal axis of the shank 1. Axial tensions in the dowel also increase with rising displacements. With their component parallel to the shear load, these also make a significant contribution to the failure load of the dowel. They also lead to deformations of the shank 1, which also increase the displacements of the portion 2. This makes it clear that with a very great increase in the failure displacement, there is only a minor loss in the dowel failure load or even a marked increase in the latter, as a function of which of the aforementioned consideration methods is chosen. This will be made clear hereinafter by the graph of FIG. 7.

Figure 3:
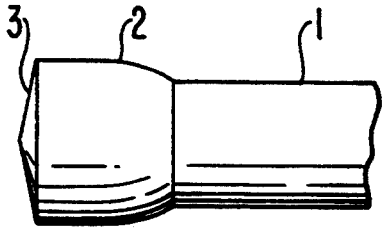
FIG. 3. A side view of a dowel of the present invention with an upwardly bulging portion.
Figure 4:
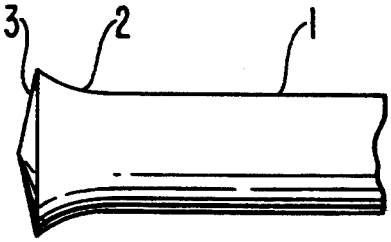
FIG. 4. A side view of a dowel of the present invention with an inwardly bulging portion.
Figure 5:
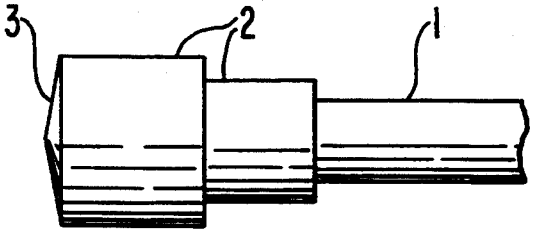
FIG. 5. A side view of a dowel of the present invention with two step portions.
Figure 6:
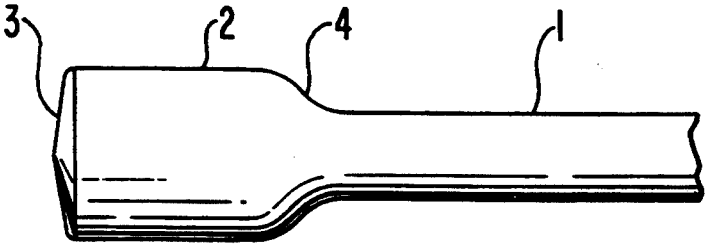
FIG. 6. A side view of a dowel of another embodiment constructed in accordance with the present invention.

In conjunction with different concrete types, the constructions of FIGS. 3, 4 and 5 can lead to a much better load-carrying behavior in the case of shear loading.

Figure 7:
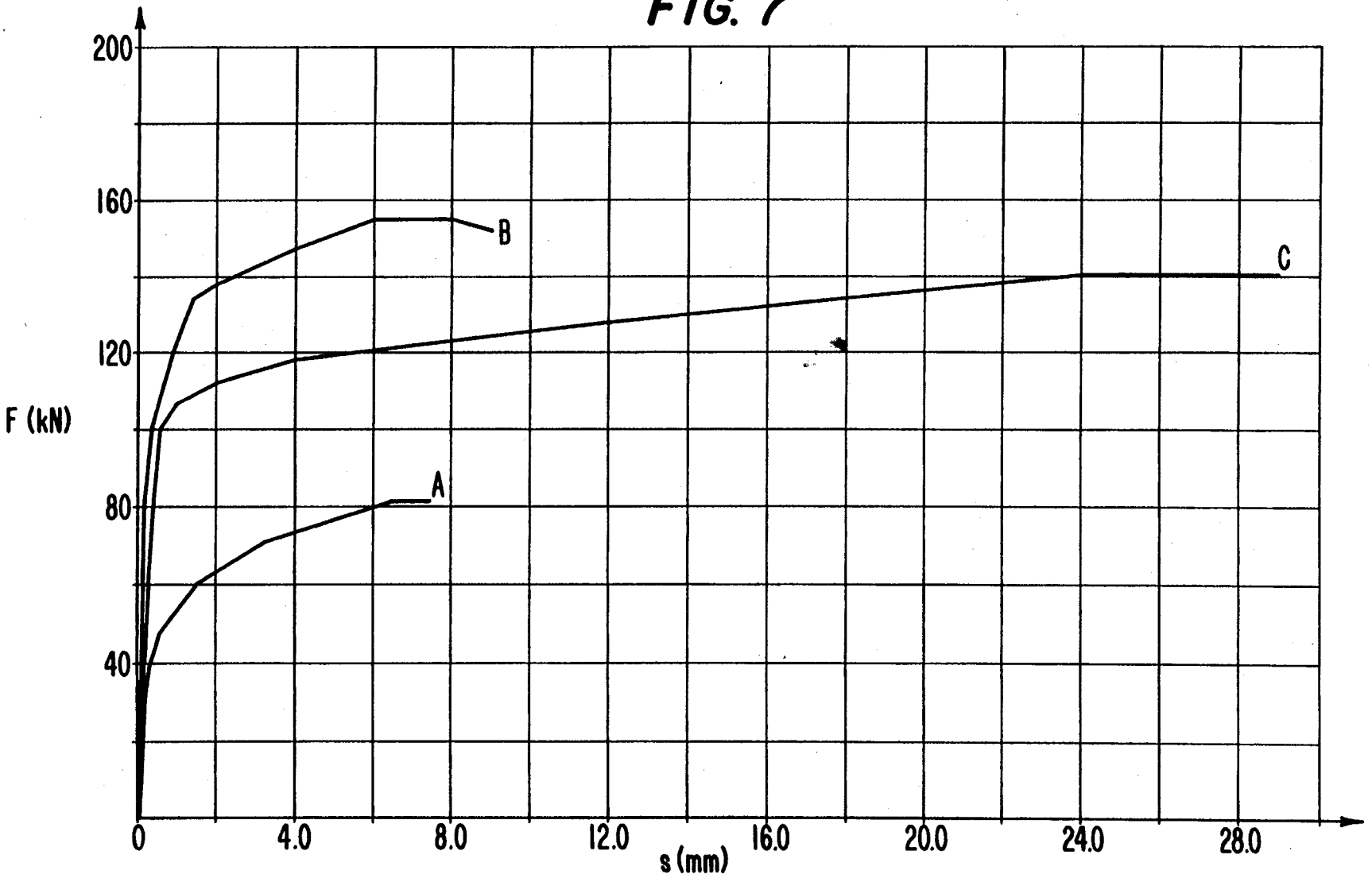
FIG. 7. A graphical illustration of a comparison of low-strain line of two conventional dowels and one dowel constructed in accordance with the present invention.

In the graph according to FIG. 7 are plotted the load-strain lines of three dowels. Two of these lines, namely lines A and B, show the load-strain behavior of conventional dowels. Both dowels have the same length and a constant cross-section over the entire length. The length corresponds to the total length of the dowel according to FIG. 1. The diameter corresponds to the diameter of the shank 1 according to FIG. 1 for curve A and the diameter of portion 2 according to FIG. 1 for curve B. In the graph the shear force F is plotted in kN over the shear displacement s in mm., with s representing the relative displacement of the steel components and therefore also the dowel base with respect to the concrete part. As is clear, from curve A in FIG. 7 and the associated dowel, the failure load is approximately 80 kN and the failure approximately 7.5 mm, whereas, for curve B and the associated dowel, the failure load is approximately 155 kN and the failure displacement approximately 9.0 mm. Curve C results from a test carried out on a dowel according to FIG. 1, whose shank diameter over approximately 80% of the dowel length corresponded to that of the dowel according to curve A and whose diameter in the reinforced portion corresponded to that of the dowel according to curve B. It can be seen that the failure load with approximately 140 kN is somewhat lower than for curve B, but with approximately 29 mm there was a marked increase in the failure displacement. These values show that for the constructional conditions according to this example the working capacity or energy of the dowel was increased by a factor of 5.5 or 3.0 compared with the dowels of curves A and B by providing a reinforced cross-section portion. These values can be influenced by modifying the constructional details.

Naturally the load-carrying behavior and bearing capacity of an inventive dowel in the case of tensile loading largely correspond to those of a conventional dowel with a constant diameter corresponding to the diameter of the shank 1. However, often the shear loads are decisive for the dowel design, so that such an increased failure displacement, the markedly increased working capacity and the high failure loads in the shear direction are much more decisive. Particular significance is attached to the high failure displacements, for example when using the limit design method in composite composition. Another advantage of the reduced dowel diameter in the shank region in accordance with FIG. 1 is the fact that there is more space for positioning reinforcing rods in the concrete C. This is, for example, significant when using anchor plates, in whose vicinity it is often necessary to have a reinforced accumulation.

We claim:

1. A steel-concrete composition construction comprising:

a steel component and a concrete component connected to each other by at least one metal dowel entirely inserted into the concrete component; and wherein the at least one metal dowel is formed from a shank which includes a central shank portion which has attached at one end a weld-on end portion welded to the steel component which transmits shear forces between the concrete component and the steel component;

the weld-on end portion has a larger cross-section than a cross-section of the central shank portion with a head attached to one end of the central shank portion opposite to the weld-on end portion with a diameter of the head being at least as large as a diameter of the weld-on end portion;

an outer diameter of the central shank portion and the weld-on end portion are circular in shape with the outer diameter of the central shank portion totally contacting the concrete component.

2. A steel-concrete composition construction according to claim 1, wherein the weld-on end portion and the central shank portion are constructed in a rotationally symmetrical manner with respect to a common axis.

3. A steel-concrete composite construction according to claim 1, wherein the at least one metal dowel includes a head disposed at an end of the central shank portion opposite to the weld-on end portion and wherein a ratio of a length of the weld-on end portion to a length of the central shank portion is between 1:3 and 1:8.

4. A steel-concrete composite construction according to claim 1, wherein a ratio of a length of the weld-on end portion to a length of the central shank portion is between 1:4 and 1:7.

5. A steel-concrete composite construction according to claim 1, wherein the weld-on end portion is convex in an axial direction.

6. A steel-concrete composite construction according to claim 1, wherein the weld-on end portion passes with a constant taper into the shank.

7. A steel-concrete composite construction according to claim 1, wherein a length to diameter ratio of the weld-on end portion is between 1:2 and 4:2.

8. A steel-concrete composite construction according to claim 7, wherein a length to diameter ratio of the weld-on end portion is between 1:2 and 3:2.

9. A steel-concrete composite construction according to claim 1, wherein a length to diameter ratio of the central shank portion excluding a length of a head of the at least one metal dowel and a length of the weld-on end portion is approximately 3:1 or greater.

10. A steel-concrete composite construction according to claim 1, wherein a ratio of a diameter of the weld-on end portion to a diameter of the central shank portion is between approximately 7:6 and 10:6.

11. A steel-concrete composite construction according to claim 10, wherein the ratio of the diameter of the weld-on end portion to the diameter of the shank is between approximately 9:6.

12. A steel-concrete composite construction according to claim 1, wherein a ratio of the length of the weld-on end portion to a length of the central shank portion is at least 1:3.

13. A steel-concrete composite construction according to claim 1, wherein the weld-on end portion has a stepped cross-sectional enlargement.

* * * * *